US008622769B2

(12) United States Patent
Mizutani et al.

(10) Patent No.: US 8,622,769 B2
(45) **Date of Patent: *Jan. 7, 2014**

(54) TERMINAL FITTING AND FLUIDPROOF CONNECTOR PROVIDED THEREWITH

(75) Inventors: Yoshihiro Mizutani, Yokkaichi (JP); Hiroko Kato, Yokkaichi (JP); Shinji Hirano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 46 days.

This patent is subject to a terminal disclaimer.

(21) Appl. No.: 13/366,714

(22) Filed: Feb. 6, 2012

(65) Prior Publication Data

US 2012/0220149 A1 Aug. 30, 2012

(30) Foreign Application Priority Data

Feb. 28, 2011 (JP) ..... 2011-041342

(51) Int. Cl.
*H01R 13/40* (2006.01)

(52) U.S. Cl.
USPC ..... 439/595

(58) Field of Classification Search
USPC ..... 439/752.5, 595, 382, 485
See application file for complete search history.

(56) References Cited

U.S. PATENT DOCUMENTS

| | | | | |
|---|---|---|---|---|
| 5,743,771 | A | 4/1998 | Yamaguchi et al. | |
| 6,146,215 | A | 11/2000 | Matsushita et al. | |
| 6,817,904 | B2 | 11/2004 | Ishikawa et al. | |
| 6,953,365 | B2 | 10/2005 | Tabata et al. | |
| 7,658,644 | B2 | 2/2010 | Ahn | |
| 2002/0081828 | A1 | 6/2002 | Tanaka | |
| 2003/0228797 | A1 | 12/2003 | Ishikawa et al. | |
| 2005/0191912 | A1 | 9/2005 | Maeda | |
| 2006/0110976 | A1 | 5/2006 | Osada et al. | |
| 2007/0238353 | A1 | 10/2007 | Yamaoka | |
| 2012/0220173 | A1 * | 8/2012 | Mizutani et al. | 439/752.5 |

FOREIGN PATENT DOCUMENTS

| | | |
|---|---|---|
| JP | 2005-183842 | 7/2005 |

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A female terminal has left and right stabilizers (30) extending from one surface of a rectangular tubular main portion (21). The stabilizers (30) are formed at predetermined distances in from opposite left and right lateral edges of the surface of the main portion (21) toward a widthwise center and assume oblique postures so that both extending ends gradually come closer to each other. The extending ends of the both stabilizers (30) are located within a circumscribed circle (X) of the main portion (21), C-surfaces (35A) are formed on corner portions of the outer lateral edges of extending end surfaces (31) of the both stabilizers (30) and R-surfaces (37A) are formed on lateral edges (36) of the C-surfaces (35A) on base end sides of the stabilizers (30).

11 Claims, 18 Drawing Sheets

TERMINAL FITTING AND FLUIDPROOF CONNECTOR PROVIDED THEREWITH

BACKGROUND OF THE INVENTION

1. Field of the Invention

The invention relates to a terminal fitting with one or more stabilizers for preventing inverted insertion and to a fluid- or waterproof connector provided with such a terminal fitting.

2. Description of the Related Art

U.S. Pat. No. 5,743,771 discloses a terminal fitting shaped so that two stabilizers extend vertically from opposite left and right lateral edges of the bottom surface of a rectangular tubular main portion. The terminal fitting is crimped and connected to an end of a wire, and a rubber plug is mounted on the rear of the terminal fitting when the terminal fitting is accommodated in an individual waterproof connector.

On the other hand, a housing is formed with cavities into which the terminal fittings are inserted. Each cavity is shaped to include a rectangular terminal accommodating hole for closely receiving the main portion of the terminal fitting. A circular sealing hole is continuous with and behind the terminal accommodating hole and is cross-sectionally larger than the terminal accommodating hole to allow the rubber plug to be closely fit. Left and right insertion paths are formed in the bottom wall of the terminal accommodating hole for permitting passage of the stabilizers of the terminal fitting.

When the terminal fitting is inserted in a proper posture into the corresponding cavity of the housing, the main portion of the terminal fitting is inserted to a proper position into the terminal accommodating hole, the stabilizers are inserted into the insertion paths, and the rubber plug is fit closely in the sealing hole.

On the other hand, if the terminal fitting is inserted in a vertically inverted posture, the stabilizers contact an edge at a side of the terminal accommodating hole vertically opposite to the side where the insertion paths are provided to prevent further insertion of the inverted terminal fitting.

A demand exists for smaller individual waterproof connectors that accommodate such terminal fittings. Accordingly, consideration has been given to reducing the diameters of the rubber plug and the sealing hole into which the rubber plug is fit. For example, the diameter of the sealing hole could be close to the diameter of a circumscribed circle of the main portion of the terminal fitting. In this case, it is necessary to prevent projecting ends of the stabilizers from interfering with and scratching the inner peripheral surface of the sealing hole when inserting the terminal fitting into the cavity.

FIG. 17 shows a terminal fitting that is intended to prevent scratching the sealing hole. More particularly, the terminal fitting of FIG. 17 has a main portion 1 and left and right stabilizers 2A aligned to approach one another at farther distances from the main portion 1 so that ends of the stabilizers 2A are located within a circumscribed circle x of the main portion 1. According to this design, the stabilizers 2A must be long and inclined a large amount if the main portion 1 is wide. These long inclined stabilizers 2A are likely to be deformed when contacting the edge of the terminal accommodating hole and an inverted insertion preventing function may not be fulfilled.

FIG. 18 shows another miniaturized terminal fitting that is intended to prevent inverted insertion. The terminal fitting of FIG. 18 has a main portion 1 and left and right stabilizers 2B that extend vertically down from positions spaced in from the opposite left and right lateral edges of the bottom surface of the main portion 1. Again, the stabilizers 2B are within a circumscribed circle x of the main portion 1. The stabilizers

2B are difficult to deform and can fulfill the inverted insertion preventing function sufficiently.

Outer corners at projecting ends of the stabilizers 2B of FIG. 18 are hammered to form C-surfaces 3 to prevent the stabilizers 2B from biting into the inner peripheral surface of the sealing hole. Nevertheless, edges 4 are formed on the lateral projecting edges of the chamfers 3. A receiving die of a press machine prevents further hammering of the chamfers 3, and hence the edges 4 must be left as shown in FIG. 18. Therefore, scratching on the inner peripheral surface of the sealing hole cannot be avoided with certainty and a waterproof function may be impaired.

The invention was completed in view of the above situation and an object thereof is to provide a terminal fitting capable of reliably fulfilling an inverted insertion preventing function and ensuring a waterproof function.

SUMMARY OF THE INVENTION

The invention relates to a terminal fitting for a fluid- or waterproof connector in which the terminal fitting and a resilient plug are mounted on an end of a wire. The terminal fitting is inserted into and accommodated in a cavity of a connector housing and the resilient plug is fit into an entrance of the cavity to provide sealing. The terminal fitting has a main portion in the form of a substantially rectangular tube. At least one stabilizer extends from one surface of the main portion for preventing inverted insertion. The stabilizer is formed at a specified distance in from a lateral edge of one surface of the main portion toward a widthwise center and has such an oblique posture toward the widthwise center that the extending end of the stabilizer is within a circumscribed circle of the main portion. At least one C-surface is formed on corners of the outer lateral edges of an extending end surface of the stabilizer and at least one R-surface is formed on a lateral edge of the C-surface on a base end side of the stabilizer.

The at least one stabilizer preferably comprises two stabilizers formed at positions at a specified distance in from opposite left and right lateral edges of the one surface of the main portion toward the widthwise center and assume such oblique postures that both extending ends gradually come closer to each other. The extending ends of the stabilizers are located within a circumscribed circle of the main portion.

C-surfaces are formed on corner portions of the outer lateral edges of extending end surfaces of the both stabilizers and R-surfaces are formed on lateral edges of the C-surfaces on base end sides of the stabilizers. Here, C-surfaces are straight chamfers and the R-surfaces are curved chamfers.

Several significant functions and effects can be obtained if the entrance of the cavity is as small as possible in conformity with the circumscribed circle of the main portion including the stabilizers. For example, left and right stabilizers are formed at positions inward of the left and right edges of one surface of the main portion and assume oblique postures so that the extending ends gradually approach each other and lie within the circumscribed circle of the main portion. Thus, to attain necessary engaging margins, an angle of inclination of the stabilizers can be suppressed maximally and the stabilizers can be short. As a result, the stabilizers difficult to incline and deform, and reliably fulfill an inverted insertion preventing function.

Further, the C-surfaces are formed on the corners of the outer lateral edges of the extending end surfaces of the respective stabilizers. Thus, the extending ends of the stabilizers will not interfere with the inner peripheral surface of the entrance of the cavity. Edges are still present on the opposite lateral edges of the C-surfaces. However, the stabilizers are inclined obliquely in and the lateral edges on the tip sides of the C-surfaces are located inside the circumscribed circle of the main portion. The lateral edges on the base sides of the C-surface are located on the circumscribed circle, but are hammered to form the R-surfaces. Thus, the edges of the stabilizers that will interface with the inner peripheral surface of the entrance of the cavity are eliminated and the stabilizers will not scratch the inner peripheral surface of the entrance of the cavity.

Thus, the stabilizers reliably fulfill the inverted insertion preventing function and ensure a waterproof function by preventing the stabilizers from scratching the inner peripheral surface of the entrance of the cavity.

The C-surfaces preferably are on outer corner portions of front end surfaces of the stabilizers in an inserting direction of the terminal fitting and the R-surfaces are on the rear edges of the C-surfaces. Thus, the stabilizers are guided smoothly into the cavity by the C-surfaces and the R-surfaces on the front ends of the stabilizers even if the stabilizers contact entrance edges of the cavity while inserting the terminal fitting.

A lance hole may be formed in the one surface of the main portion for engaging a locking lance in the cavity. The stabilizers may be formed by bending cut pieces at substantially opposite lateral edges of the lance hole. Furthermore, reinforcing beads may be formed over the stabilizers. This construction can prevent the stabilizers from being inclined and deformed more than necessary.

The stabilizer may have a narrower than the length of the lance hole in forward and backward directions and a short extending dimension of the stabilizer may be less than about half of the width thereof.

The invention also relates a water- or fluidproof connector comprising a housing and at least one of the above-described terminal fittings mounted on an end of a wire together with a resilient plug. The terminal fitting is inserted into a cavity of the housing so that the resilient plug is fit into an entrance of the cavity to provide sealing.

The cavity preferably has a terminal accommodating hole for closely receiving the main portion of the terminal fitting. The main portion of the terminal fitting has a wide rectangular cross section. A sealing hole with a circular cross section is formed rearward of and communicates with the terminal accommodating hole. The sealing hole receives the resilient plug mounted on a rear end of the terminal fitting and preferably has the same diameter as the circumscribed circle of the main portion of the female terminal.

At least one restriction preferably is formed at an edge of the terminal accommodating hole and preferably includes a ceiling wall of a tapered hole for preventing any further insertion of the terminal fitting by the contact with the stabilizers when the terminal fitting is inserted in an improper posture.

Accordingly, it is possible to reliably fulfill an inverted insertion preventing function and ensure a waterproof function by preventing scratching on the inner peripheral surface of the entrance of the cavity.

These and other objects, features and advantages of the invention will become more apparent upon reading the following detailed description of preferred embodiments and accompanying drawings.

DETAILED DESCRIPTION OF THE PREFERRED EMBODIMENTS

A connector in accordance with the invention of this embodiment includes two female terminals 20 fixed to respective ends of wires 10 and a female housing 40 for accommodating the female terminals 20.

Figure 1:
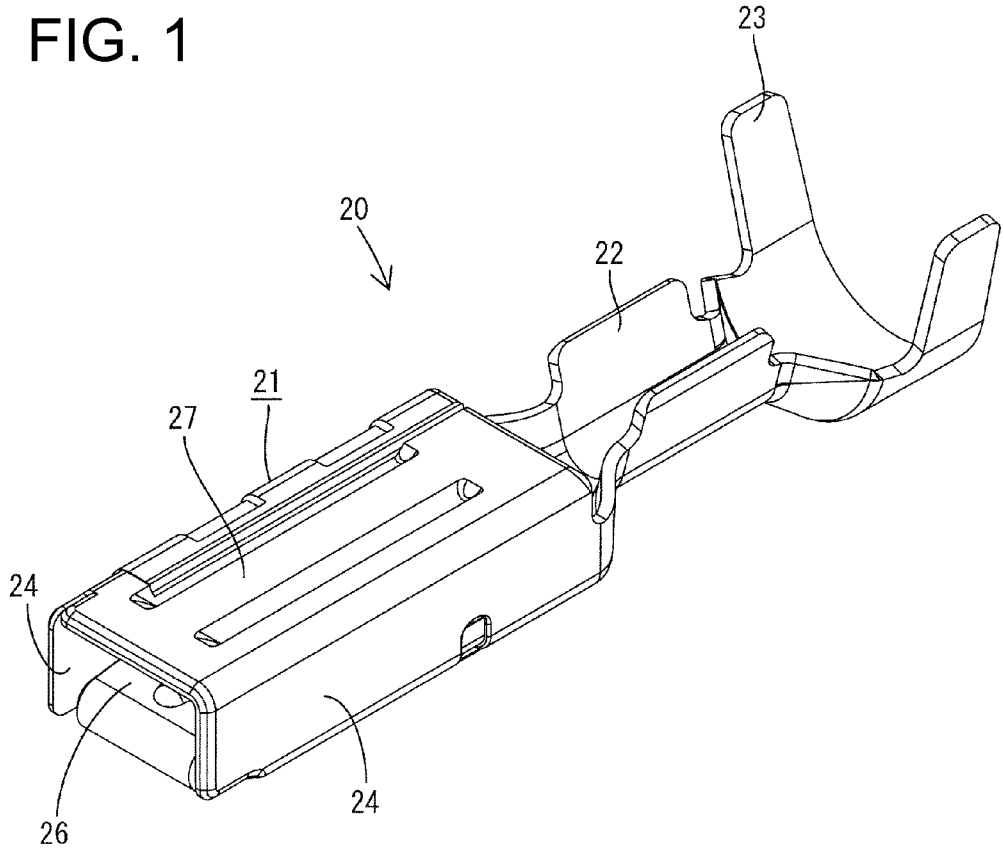
FIG. 1 is a perspective view of a female terminal according to one embodiment of the present invention.
Figure 2:
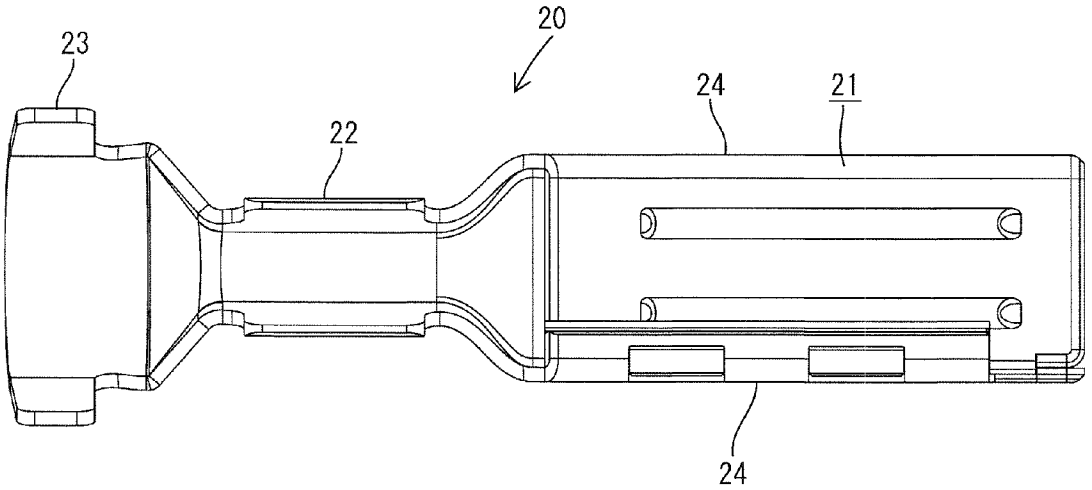
FIG. 2 is a plan view of the female terminal.

The female terminal 20, as illustrated in FIGS. 1 to 7, is formed by press-working a conductive metal plate with excellent electrical conductivity and includes a main portion 21 for receiving a tab of a mating male terminal (not shown). A wire connection portion is behind the main portion 21 and includes at least one wire barrel 22 and at least one insulation barrel 23 to be crimped, bent or folded and connected to the end of the wire 10, as shown in FIG. 1.

The main portion 21 is a rectangular tube that is long in forward and backward directions and has a wide cross section. Four corners of the main portion 21 are rounded. A resilient contact piece 26 is provided in the main portion 21 and is formed by folding a tongue extending from the front edge of a bottom plate 25 to have a mountain or pointed shape. Two elongated projections 28 are formed on the inner surface of a ceiling plate 27 by hammering. The projections 28 are long in forward and backward directions and are spaced part in a width direction The tab of the mating male terminal is inserted into the main portion 21 through a front opening and is sandwiched resiliently between the resilient contact piece 26 and the elongated projections 28 and electrical connection is established between the female terminal 20 and the male terminal.

The bottom plate 25 of the main portion 21 is formed with a lance hole 29 to be engaged with a locking lance 57 in a cavity 50 of the female housing 40. Stabilizers 30 prevent the female terminal 20 from being inserted erroneously into the cavity 50 in a vertically inverted posture. The stabilizers 30 are described later.

Figure 14:
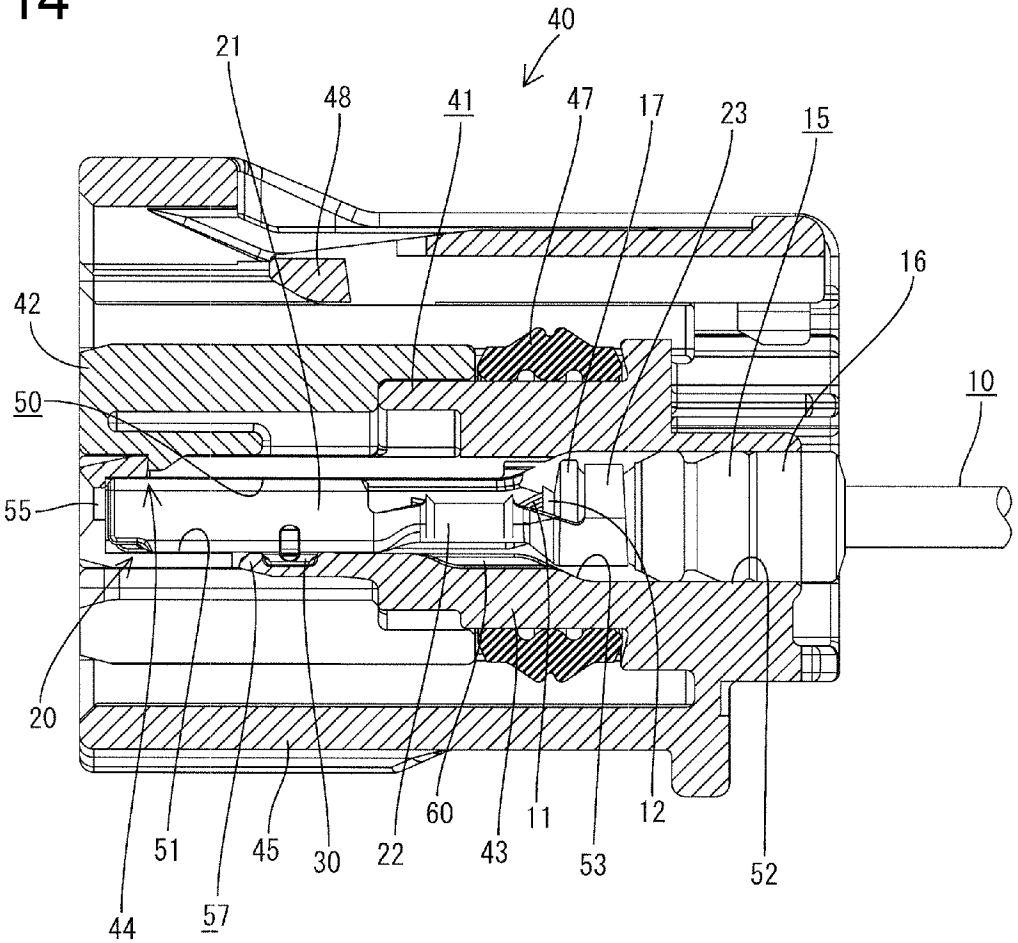
FIG. 14 is a longitudinal section when a female terminal is inserted in a proper posture.

The female terminal 20 is fixed to the end of the wire 10 together with the rubber plug 15, as shown in FIG. 14. The rubber plug 15 is long in forward and backward directions and has a plug body 16 and a mounting portion 17 on the front surface of the plug body 16. The plug body 16 has a diameter somewhat larger than that of a circumscribing circle X (see FIG. 7) of the main portion 21 of the female terminal 20. The rubber plug 15 also has a center hole for closely receiving the wire 10.

The wire barrel 22 is to be crimped, bent or folded and connected to an end of a core 11 exposed by stripping the wire 10. The insulation barrel 23 is to be crimped, bent or folded and connected to an end of an insulation coating 12 and the mounting portion 17 of the rubber plug 15. Thus, the female terminal 20 and the rubber plug 15 are mounted on the end of the wire 10.

Figure 3:
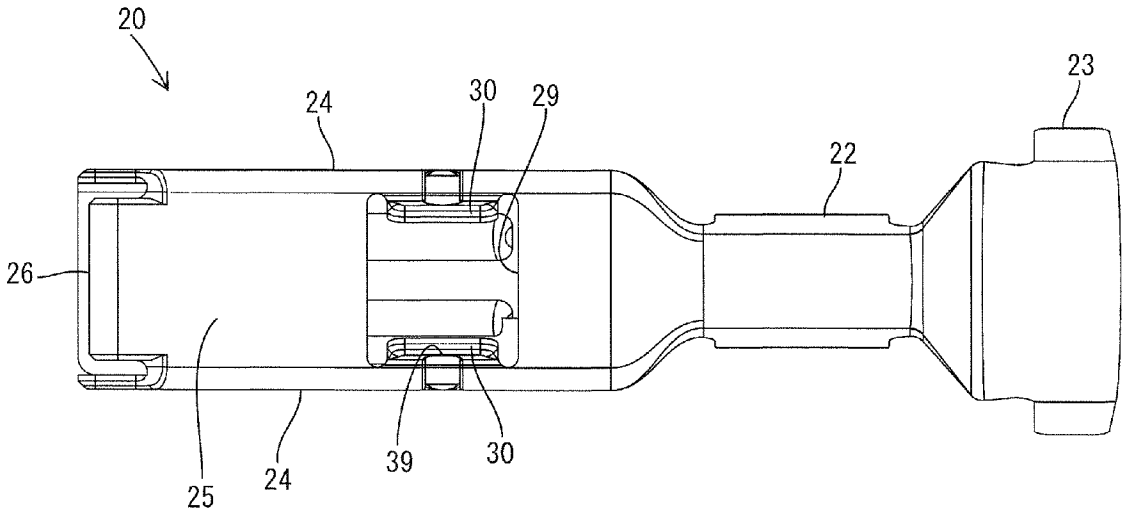
FIG. 3 is a bottom view of the female terminal.
Figure 4:
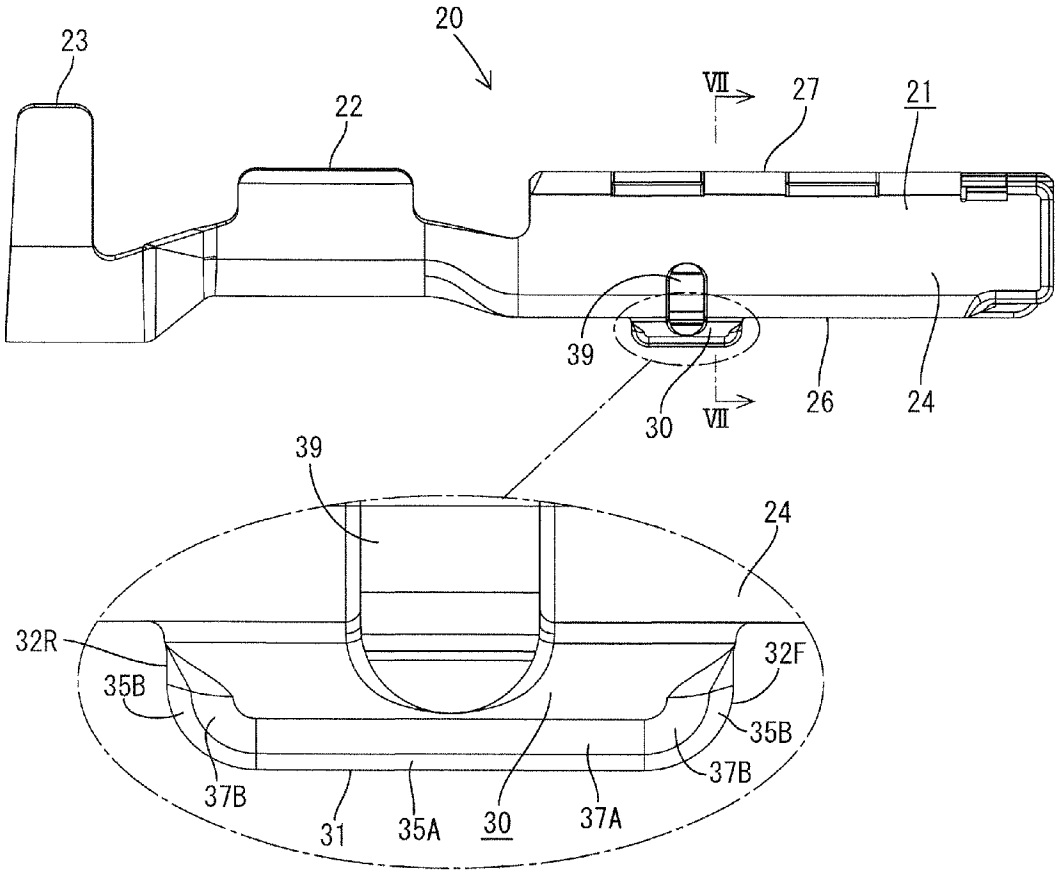
FIG. 4 is a side view of the female terminal.
Figure 5:
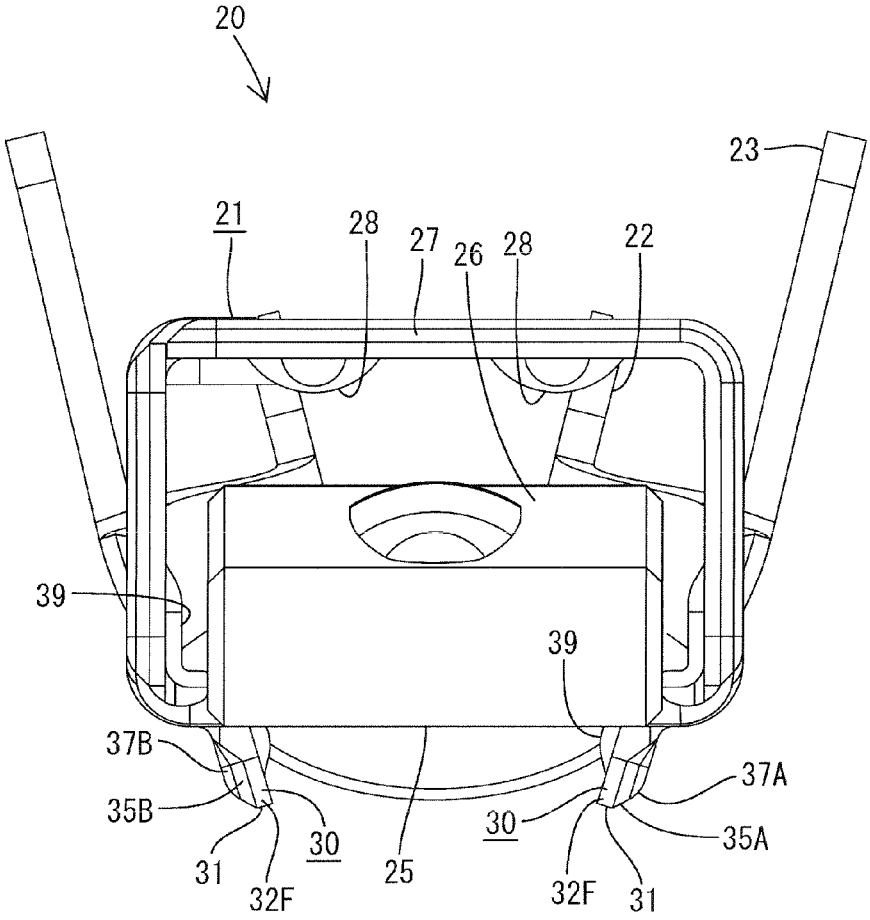
FIG. 5 is an enlarged front view of the female terminal.
Figure 6:
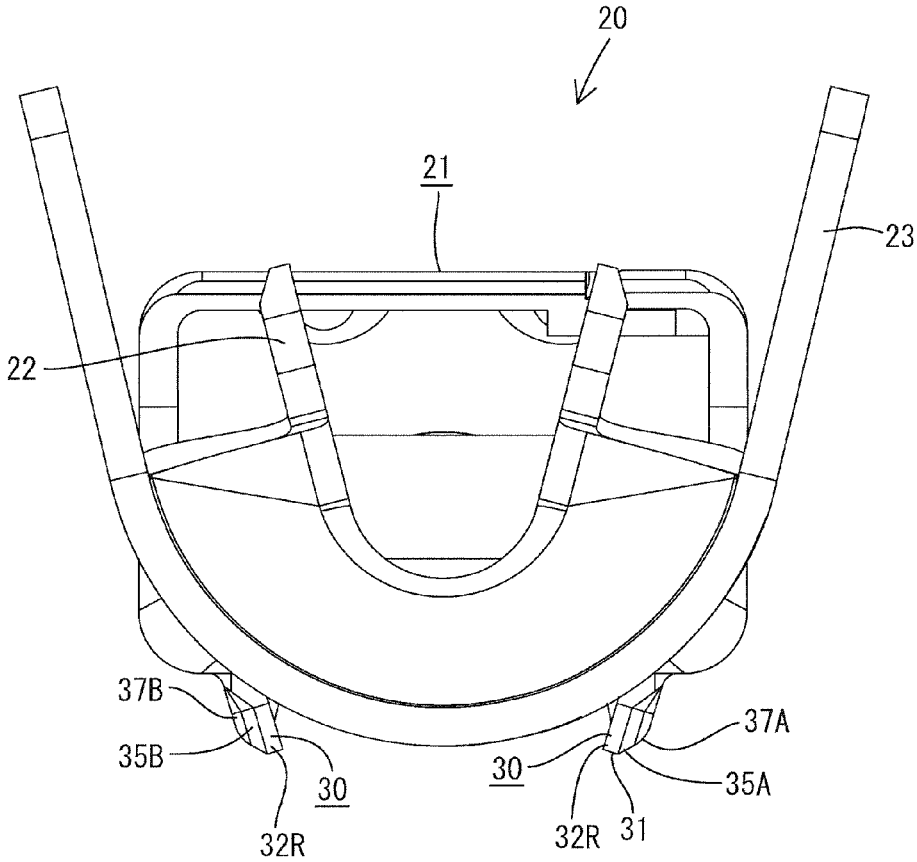
FIG. 6 is an enlarged rear view of the female terminal.

As shown in FIG. 3, the lance hole 29 is open in the bottom surface of the main portion 21 of the female terminal 20. More specifically, the lance hole 29 has a wide rectangular shape with a width substantially equal to a distance between the inner surfaces of left and right side plates 24 of the main portion 21 at a position slightly behind a lengthwise central part of the bottom surface of the main portion 21.

Figure 7:
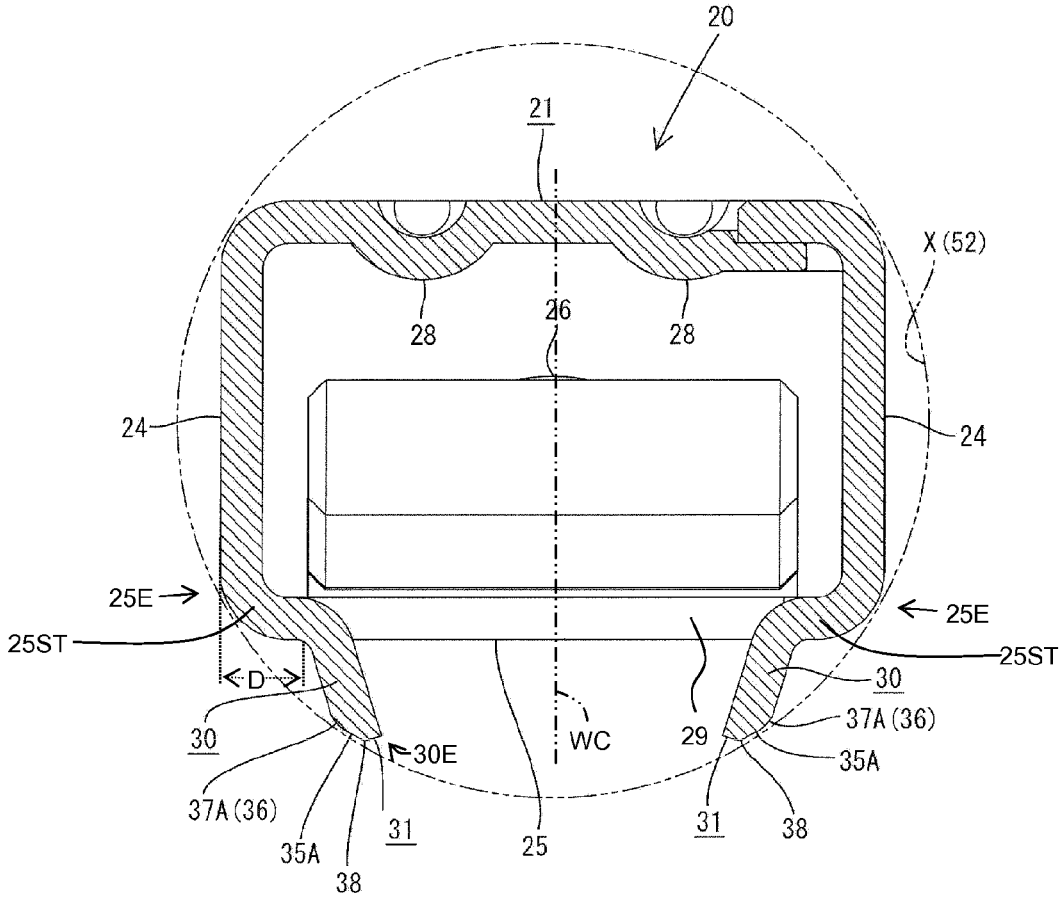
FIG. 7 is an enlarged section along VII-VII of FIG. 4.

Left and right stabilizers 30 are formed by bending cut pieces out from the left and right lateral edges of the lance hole 29. The stabilizers 30 extend at positions at a specified distance D more than about 1.5 times the thickness of the side plate 24, e.g. about twice the thickness of the side plate 24 including a bending margin from and inwardly of the opposite left and right lateral edges 25E of the bottom surface 25 of the main portion 21 toward a widthwise center WC, as shown in FIG. 7. Thus, the base end of the stabilizer 30 is spaced in from the lateral edge 25E by a distance D to form a step 25ST and the stabilizer 30 extends outwardly from the main portion 21 adjacent to the step 25ST. Furthermore, the stabilizer 30 extends obliquely with respect to the bottom surface 25 of the main portion 21 toward the widthwise center WC (defined an imaginary plane arranged in longitudinal direction of the main portion 21 and dividing the main portion 21 into two parts, see FIG. 7).

The stabilizers 30 have a width slightly shorter than the length of the lance hole 29 in forward and backward directions and a short extending dimension which is less than about half (e.g. about ¼) of the width thereof. Front and/or rear corners of the extending ends of the stabilizers 30 are rounded or beveled.

C-surfaces 35A, 35B are formed in substantially half thickness areas of the stabilizers 30 on outer corners of extending ends 30E and extend over extending end surfaces 31 and front and rear end surfaces 32F, 32R of the stabilizers 30. The C-surfaces 35A, 35B are substantially straight chamfers that are substantially straight along the forward and backward directions, see e.g. FIG. 4, and are chamfered or beveled when seen in a direction orthogonal thereto, see FIG. 7.

As shown in FIG. 7, the stabilizers 30 assume oblique postures so that their extending ends gradually come closer to each other. The extending ends 30E of both stabilizers 30 are located within the circumscribed (imaginary) circle X of the main portion 21. In other words, the stabilizers 30 are formed to be inside the imaginary circle X circumscribed around the main portion 21 of the terminal fitting 20 and tangentially contacting the corner portions of the circle X, see FIG. 7.

R-surfaces 37A are formed on lateral edges 36 at base end sides of the C-surfaces 35A, 35B formed on the outer corners. The R-surfaces 37A extend over the extending end surfaces 31 and the front and rear end surfaces 32F, 32R of the stabilizers 30, i.e. on the C-surfaces 35A. Further, R-surfaces 37B are formed on the rear edges of the C-surfaces 35B of the front end surfaces 32F and on the front edges of the C-surfaces 35B of the rear end surfaces 32R. The R-surfaces 37A, 37B are curved chamfers.

As shown in FIG. 7, forming the C-surfaces 35A on the corners of the outer lateral edges of the extending end surfaces 31 of the stabilizers 30 avoids interference of the corners with the circumscribed circle X (i.e. the stabilizers 30 are arranged inside the circle X) even if the stabilizers 30 have the extending dimension sufficient to ensure engaging margins.

Edges are still present on the opposite lateral edges of the C-surfaces 35A. However, the stabilizers 30 incline obliquely in and lateral edges 38 on the tip sides of the C-surfaces 35A are located inside the circumscribed circle X of the main portion 21 and the lateral edges 36 on the base end sides are located on the circumscribed circle X. The lateral edges 36 on the base end sides can be hammered. Thus, interference of the edges with the circumscribed circle X is avoided by forming the R-surfaces 37A on the lateral edges 36 on the base end sides of the C-surfaces 35A.

As described above, the left and right stabilizers 30 are formed by bending the cut pieces at the left and right lateral edges of the lance hole 29. Reinforcing beads 39 are formed over at least part of the stabilizers 30. Lateral edges of the lance hole 29 and the side plates 24 of the main portion 21 project outward particularly by hammering.

Figure 8:
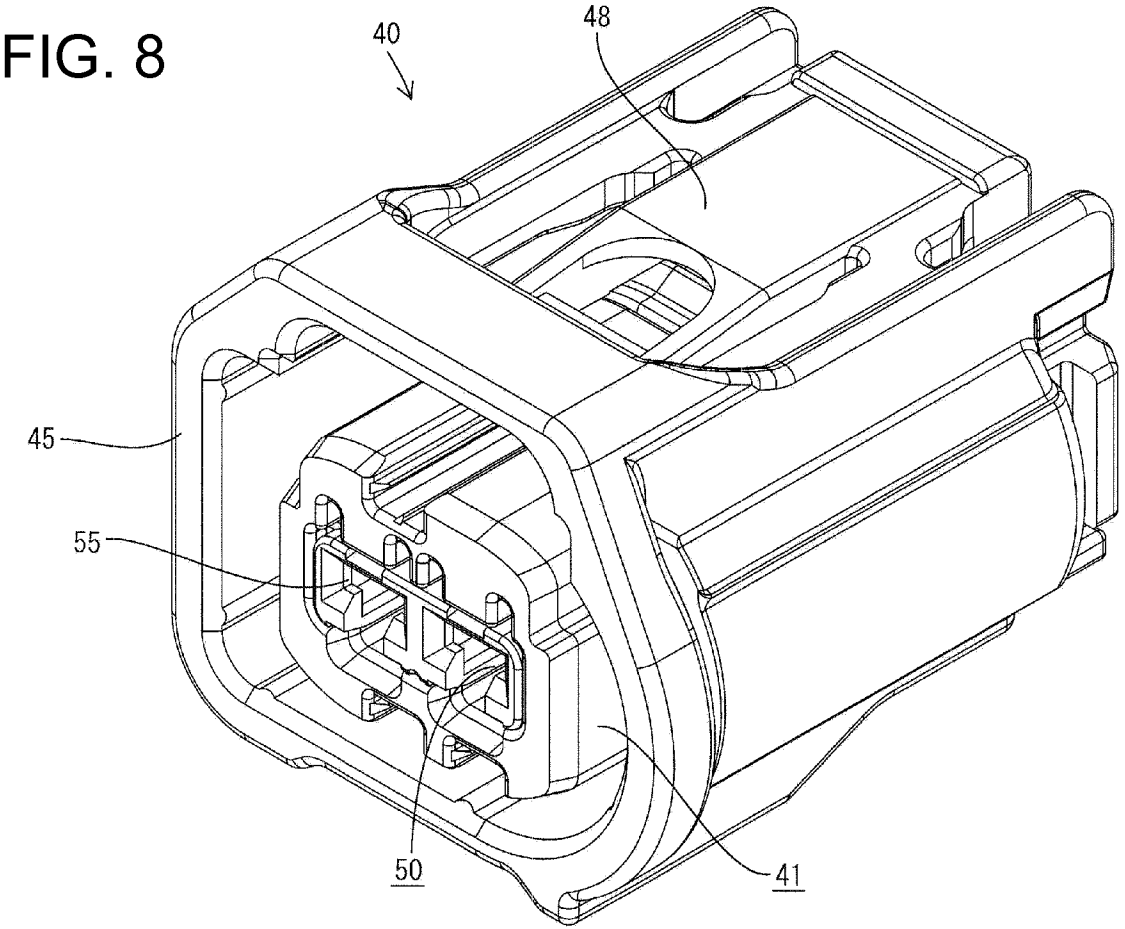
FIG. 8 is a perspective view of a female housing.
Figure 9:
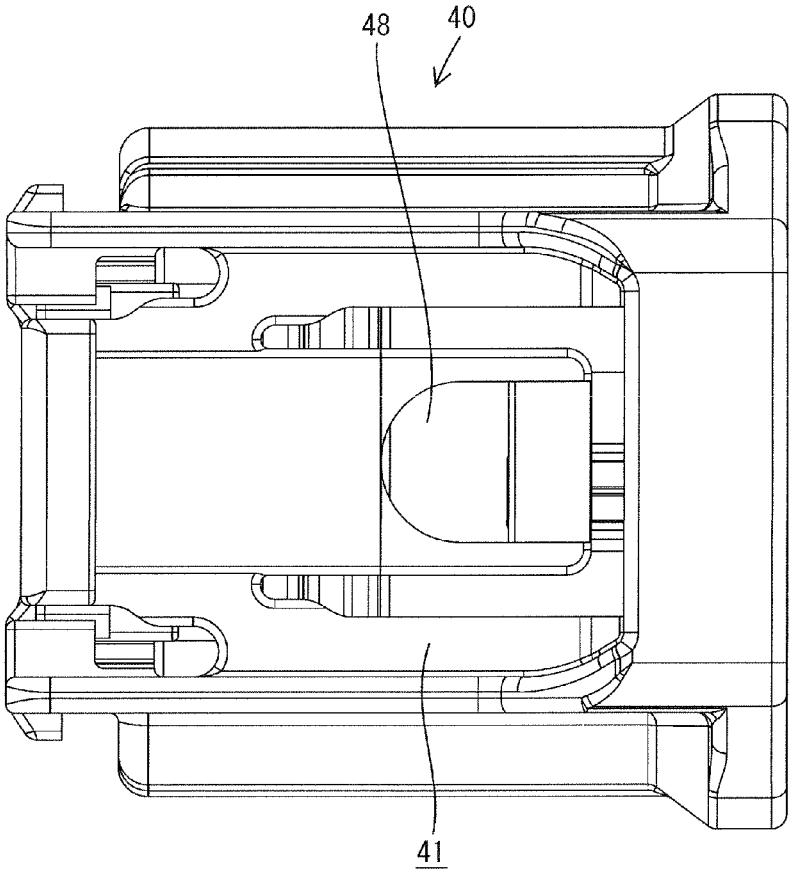
FIG. 9 is a plan view of the female housing.
Figure 10:
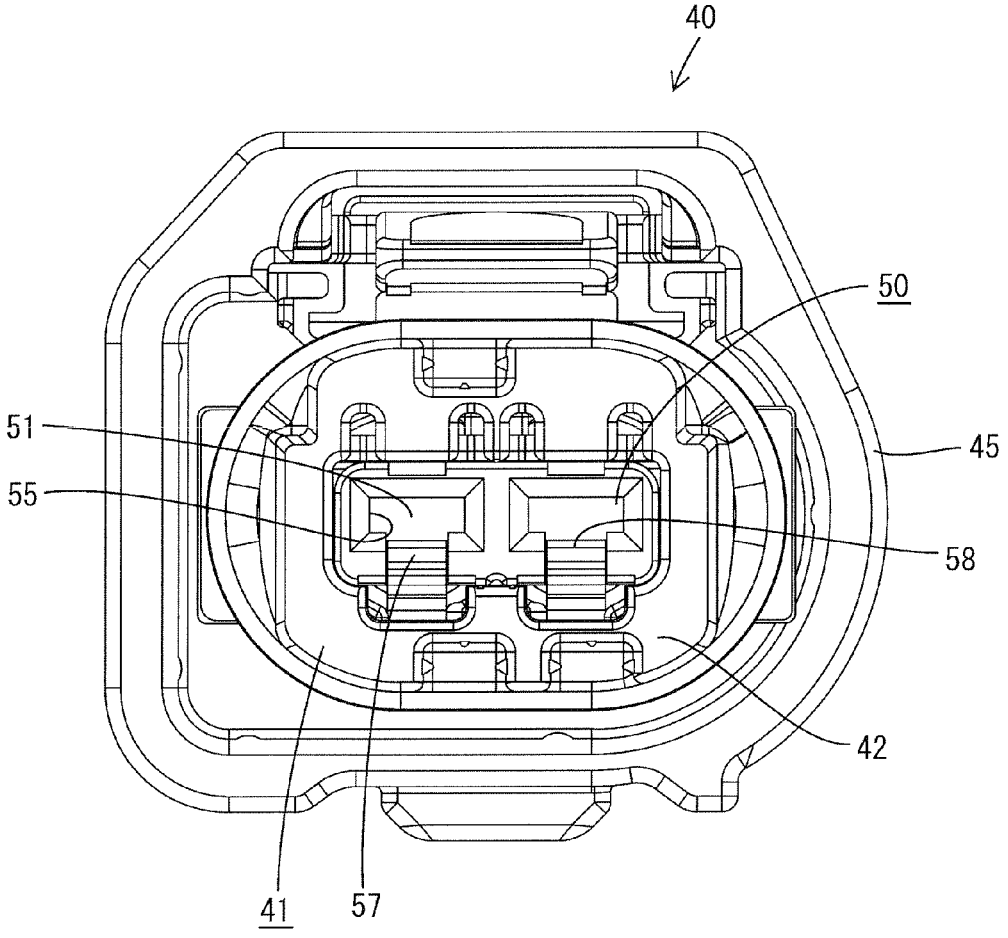
FIG. 10 is a front view of the female housing.
Figure 11:
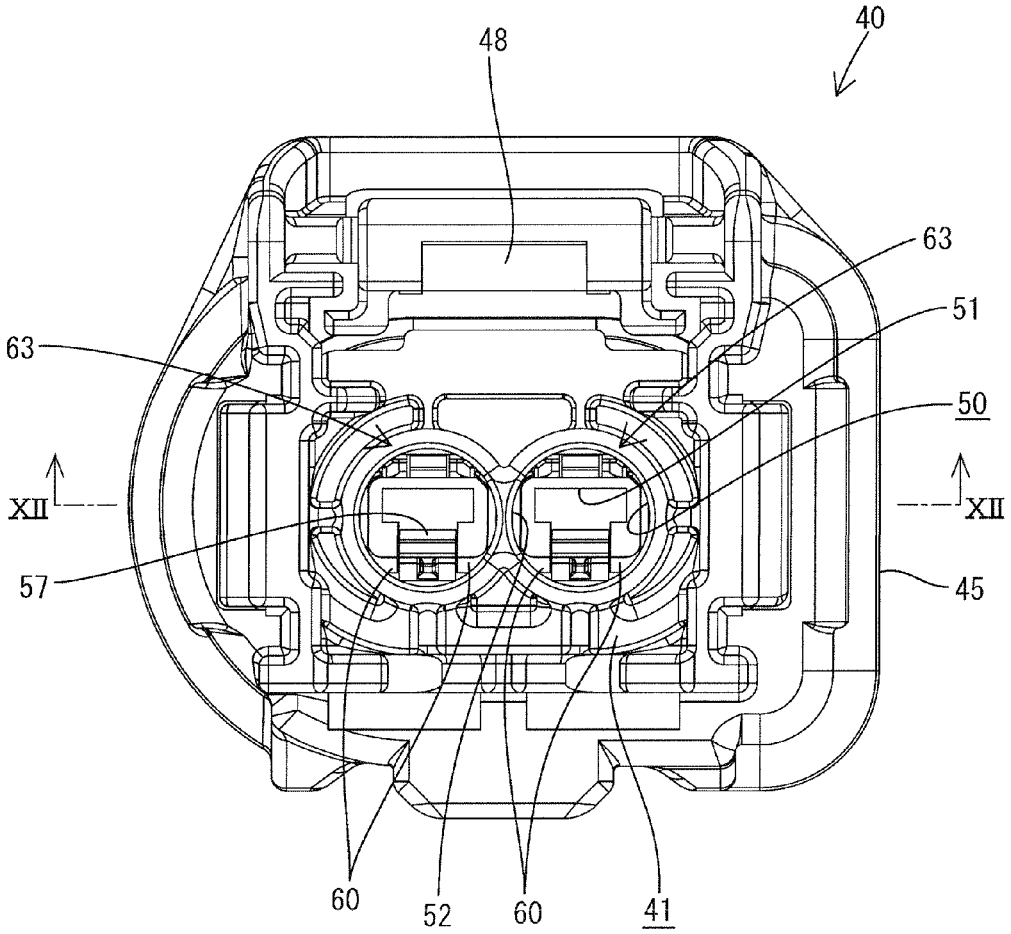
FIG. 11 is a rear view of the female housing.

The female housing 40 is made e.g. of synthetic resin and has a terminal accommodating portion 41 for receiving one or more female terminals 20, as shown in FIGS. 8 and 14. A front portion 42 of the terminal accommodating portion 41 is a separate piece integrally assembled with a rear end portion 43 via at least one lock mechanism 44. A tubular portion 45 is provided around the terminal accommodating portion 41.

The female housing 40 is connected with an unillustrated mating male housing in which male terminals are mounted. Thus, a receptacle of the male housing is inserted between the terminal accommodating portion 41 and the tubular portion 45 of the female housing 40 to provide sealing between the female housing 40 and the male housing via a seal ring 47 mounted on the base end side of the terminal accommodating portion 41. A lock arm 48 on the tubular portion 45 engages a lock of the male housing to lock the female housing 40 and the male housing in a connected state.

Two cavities 50 are formed side by side in the terminal accommodating portion 41 of the female housing 40 for receiving the above-described female terminals 20. A terminal accommodating hole 51 is formed in slightly more than the front half of each cavity 50 and has a wide rectangular cross section for closely receiving the main portion 21 of the female terminal 20. A sealing hole 52 is formed at the rear of the terminal accommodating hole 51 and has a circular cross section for closely receiving the rubber plug 15 mounted on the rear side of the female terminal 20. The sealing hole 52 has substantially the same diameter as the circumscribed circle X of the main portion 21 of the female terminal 20 described above. The rear end of the terminal accommodating hole 51 and the front end of the sealing hole 52 are connected by a tapered hole 53.

A terminal insertion opening 55 is formed in the front wall of the terminal accommodating hole 51 for receiving the tab of the male terminal. Further, a locking lance 57 is cantilevered forward from a bottom wall of the terminal accommodating hole 51. The main portion 21 of the female terminal 20 in a proper posture is inserted into the terminal accommodating hole 51 and resiliently deforms the locking lance 57. The lance hole 29 in the bottom surface of the main portion 21 of the female terminal 20 reaches the position of a projection 58 of the locking lance 57. Thus, the locking lance 57 restores resiliently so that the projection 58 fits into the lance hole 29 to lock and retain the female terminal 20.

When the female terminal 20 is inserted to the proper position, the main portion 21 and the wire barrel 22 of the female terminal 20 are accommodated in the terminal accommodating hole 51, the insulation barrel 23 of the female terminal 20 and the mounting portion 17 of the rubber plug 15 are accommodated in the tapered hole 53 and the front end of the sealing hole 52 and a front part of the plug body 16 of the rubber plug 15 is accommodated in the rear of the sealing hole 52, as shown in FIG. 14.

Substantially parallel insertion paths 60 are formed in the bottom wall of the cavity 50 and extend in forward and backward directions at opposite left and right sides of the locking lance 57. The insertion paths 60 extend from the tapered hole 53 to the terminal accommodating hole 51 and can receive the left and right stabilizers 30 projecting from the bottom surface of the main portion 21 of the female terminal 20.

A restriction 63 is formed at an upper edge of the terminal accommodating hole 51 including the ceiling wall of the tapered hole 53 for contacting the stabilizers 30 when the female terminal 20 is inserted in an improper posture for preventing any further insertion of the female terminal 20.

Figure 12:
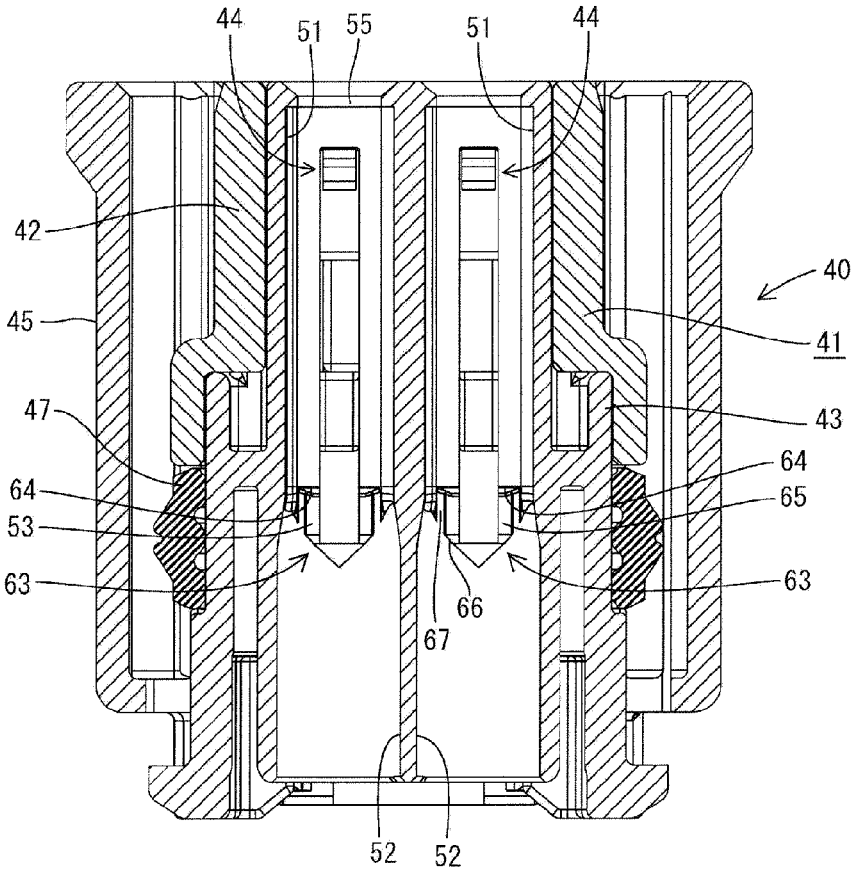
FIG. 12 is a section along XII-XII of FIG. 11.
Figure 13:
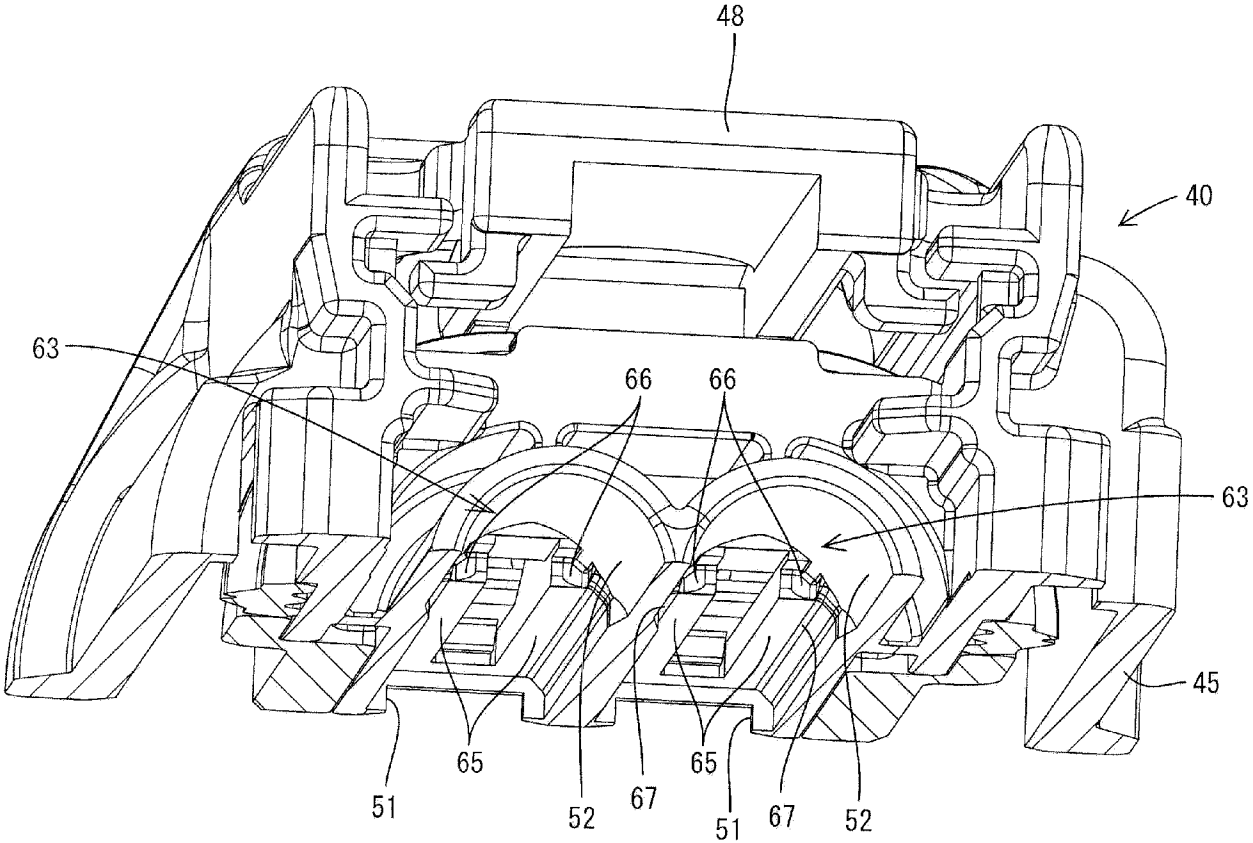
FIG. 13 is a perspective view partly in section along XII-XII of FIG. 11.

The restriction 63 is described in detail with reference to FIGS. 12 and 13. Restricting surfaces 64 are formed at an upper edge of the terminal accommodating hole 51 at positions slightly behind a connecting part of the terminal accommodating hole 51 with the tapered hole 53 and are at an angle, preferably substantially perpendicular to an axial direction. Posture displacing portions 65 in the form of left and right rectangular bars are formed substantially parallel to each other to project back (toward the sealing hole 52) from the restricting surfaces 64.

Taper surfaces 66 are formed at outer corners of the end surfaces of the respective posture displacing portions 65. The respective taper surfaces 66 are formed at positions where the left and right stabilizers 30 contact the taper surfaces 66 when the female terminal 20 is in the vertically inverted posture. Guide grooves 67 for receiving the stabilizers 30 are formed at the outer sides of the respective posture displacing portions 65 to face substantially straight in a vertical direction, and the back ends of the respective guide grooves 67 reach the restricting surfaces 64.

The female terminal 20 is inserted into the corresponding cavity 50 of the female housing 40 with the stabilizers 30 located at the lower side, as shown in FIG. 14.

The stabilizers 30 also pass through the sealing hole 52. There is a concern that extending ends of the stabilizers 30 may catch the lower hole edge of the sealing hole 52, for example, due to upward inclination of the main portion 21. However, the C-surfaces 35B and the R-surfaces 37B formed on the outer corner portions of the front end surfaces 32F of the stabilizers 30 smoothly guide the stabilizers 30 into the sealing hole 52.

The main portion 21 of the female terminal 20 including the stabilizers 30 then is pushed while sliding substantially in contact with the inner peripheral surface of the sealing hole 52. At that time, there is a concern that the lateral edges 36 on the base end sides of the C-surfaces 35A formed on the extending end surfaces 31 of the stabilizers 30 will contact the inner peripheral surface of the sealing hole 52 as shown in FIG. 7. However, the R-surfaces 37A are formed on the lateral edges 36 will not scratch the inner peripheral surface of the sealing hole 52.

When the female terminal 20 is pushed further, such as by pushing the rear end of the rubber plug 15, the front end of the main portion 21 is inserted into the terminal accommodating hole 51 while being guided by the tapered hole 53. Additionally, the main portion 21 is pushed into the terminal accommodating hole 51 in the intermediate position or middle of insertion while the stabilizers 30 are inserted into the corresponding insertion paths 60, as shown on the right side of FIG. 16. The main portion 21 is pushed to the proper position and contacts the front wall of the terminal accommodating hole 51, as shown in FIG. 14. Thus, the locking lance 57 resiliently returns and fits into the lance hole 29 to retain the female terminal 20 in the terminal accommodating hole 51. Simultaneously, the front part of the plug body 16 of the rubber plug 15 is fit closely into the rear end portion of the sealing hole 52 to seal the cavity 50.

Figure 15:
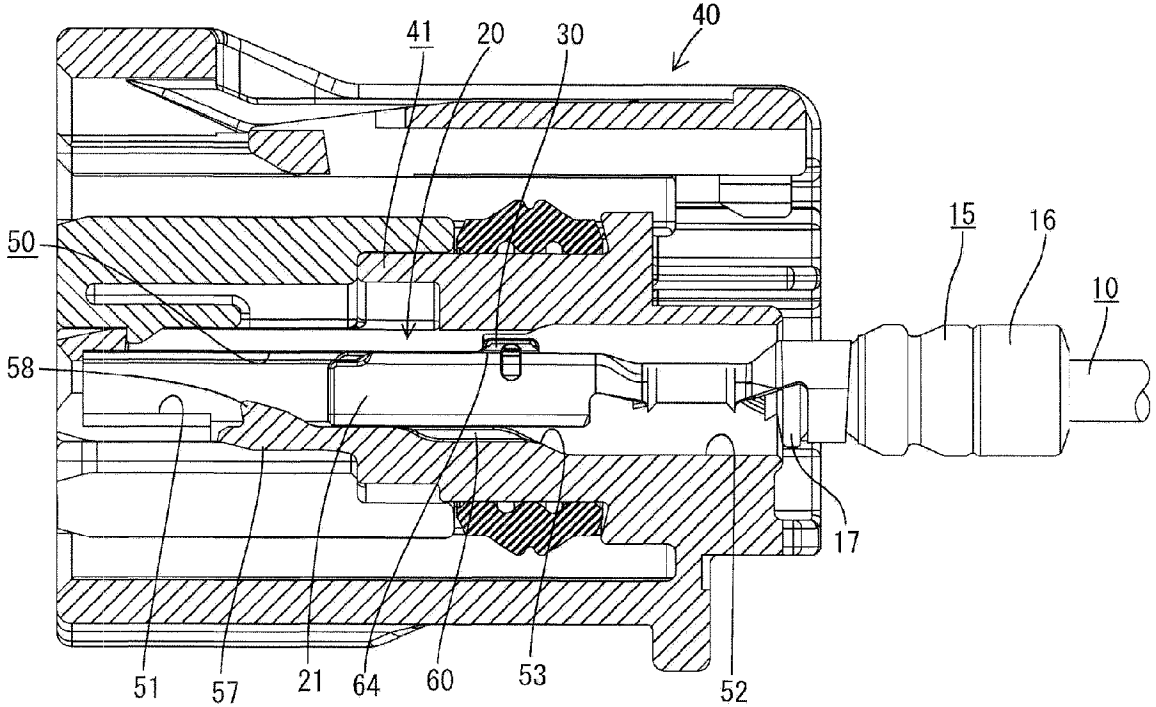
FIG. 15 is a longitudinal section when the female terminal is inserted in an inverted posture.
Figure 16:
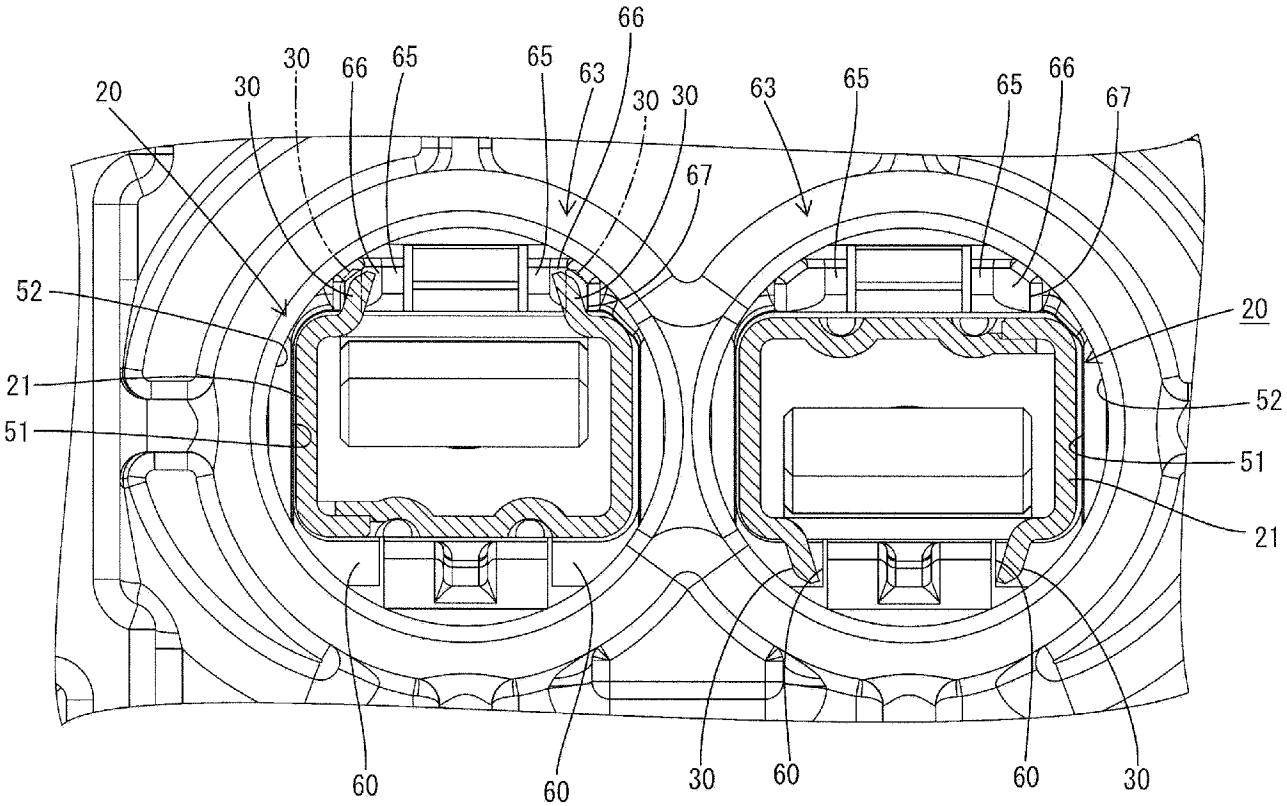
FIG. 16 is an enlarged rear view of a part where a cavity is formed.
Figure 17:
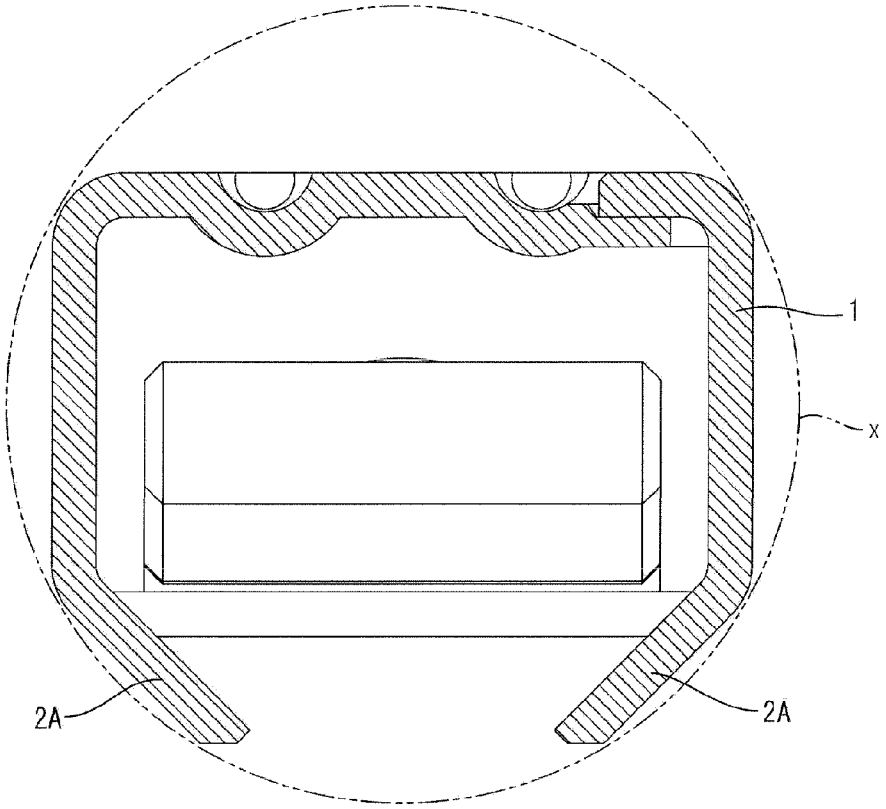
FIG. 17 is a lateral section of one conventional terminal fitting.
Figure 18:
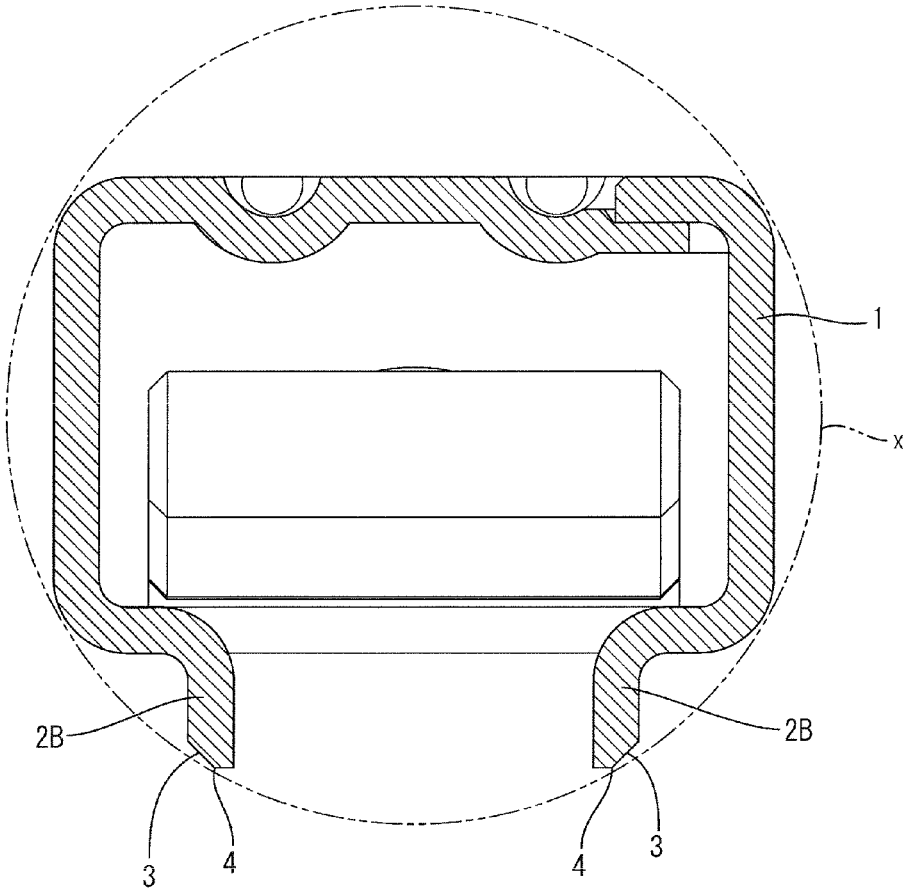
FIG. 18 is a lateral section of another conventional terminal fitting.

On the other hand, if the female terminal 20 is inserted in an improper posture, such as a vertically inverted posture where the stabilizers 30 are located at the upper side, as shown in FIG. 15, the extending ends of the both stabilizers 30 contact taper surfaces 66 of the corresponding posture displacing portions 65, as shown on the left side of FIG. 16, at a timing at which the main portion 21 is guided by the tapered hole 53 and enters the terminal accommodating hole 51. If the female terminal 20 is pushed farther, the stabilizers 30 are displaced to vertical postures by being guided by the taper surfaces 66, as shown by chain line in FIG. 16, pass in the guide grooves 67 at the outer sides of the posture displacing portions 65 while being kept in the vertical postures and then come into contact with the restricting surfaces 64, as shown in FIG. 15.

Further pushing of the female terminal 20 is prevented in the above manner and insertion of the female terminal 20 in a wrong posture is detected. Large engaging margins with the restricting surfaces 64 are ensured by displacing the stabilizers 30 to the vertical postures, and inward inclination of the stabilizers 30 is prevented by the posture displacing portions 65 at the inner sides of the stabilizers 30. Thus, the pushing of the female terminal 20 is prevented reliably.

Since the rubber plug 15 is not fitted in the sealing hole 52 when the pushing is prevented in the above manner, the female terminal 20 can be pulled back easily, such as by holding the rubber plug 15 and pulling the wire 10 backward. Thereafter, the female terminal 20 may be corrected to the proper posture and inserted again into the cavity 50.

As described above, left and right stabilizers 30 are formed at the positions inwardly of the left and right edges of the bottom surface of the main portion 21 to assume such oblique postures that the extending ends are more inward than the base ends thereof so that distal ends of the stabilizers 30 gradually come closer to each other in forming or arranging the stabilizers 30 within the circumscribed circle X of the main portion 21. Thus, to attain necessary engaging margins, an angle of inclination of the stabilizers 30 can be maximally suppressed and the stabilizers 30 can be short. Accordingly, the stabilizers 30 are difficult to incline and deform and reliably fulfill an inverted insertion preventing function.

Further, the C-surfaces 35A on the corners of the outer lateral edges of the extending end surfaces 31 of the respective stabilizers 30 avoid interference of the extending ends of the stabilizers 30 with the inner peripheral surface of the sealing hole 52 at the entrance side of the cavity 50. Here, edges are still present on the opposite lateral edges of the C-surfaces 35A. However, the stabilizers 30 are inclined obliquely in so that the lateral edges 38 on the tip sides of the stabilizers 30 are located inside the circumscribed circle X of the main portion 21. On the other hand, the lateral edges 36 on the base end sides are located on the circumscribed circle X. However, the lateral edges 36 on the base end sides can be hammered and the R-surfaces 37A are formed on the lateral edges on the base end sides of the C-surfaces 35A. Thus, the edges that could interfere with the inner peripheral surface of the sealing hole 52 are eliminated from the extending ends of the stabilizers 30 and the stabilizers 30 will not scratch the inner peripheral surface of the sealing hole 52.

Thus, it is possible to reliably fulfill the inverted insertion preventing function by the stabilizers 30 and ensure a waterproof function by preventing the stabilizers from scratching the inner peripheral surface of the sealing hole 52 of the cavity 50.

The C-surfaces 35B are formed on the outer corners of the front end surfaces 32F of the stabilizers 30 and the R-surfaces 37B are formed on the rear edges of the C-surfaces 35B. Even if the extending ends of the stabilizers 30 are caught by the lower edge of the sealing hole 52, for example, due to upward inclination of the main portion 21 when the female terminal 20 is being inserted into the sealing hole 53 of the cavity 50, the extending ends can be guided smoothly into the sealing hole 52 by the C-surfaces 35B and the R-surfaces 37B formed on the outer corners of the front end surfaces 32F of the stabilizers 30.

The left and right stabilizers 30 are formed by bending the cut pieces at the opposite left and right edges of the lance hole 29, and the reinforcing beads 39 are formed over the stabilizers 30. The lateral edges of the lance hole 29 and the side plates 24 of the main portions 21 project out by hammering. This prevents the stabilizers 30 from being inclined and deformed inward more than necessary. For example, if the female terminal 20 is inserted in an inverted posture, the front end surfaces 32F of the stabilizers 30 can be brought reliably into contact with the taper surfaces 66 of the posture displacing portions 65 to displace the stabilizers 30 to the vertical postures so that the inverted insertion preventing function can be reliably fulfilled.

The invention is not limited to the above described and illustrated embodiment. For example, the following embodiments are also included in the technical scope of the present invention.

The stabilizer structure in the female terminal of the present invention is effective as a scratch preventing means for the sealing hole of the cavity of the female housing which has at minimum a diameter equivalent to the diameter of the circumscribed circle of the main portion of the female terminal, but the stabilizer structure of the invention also may be applied in the case of accommodating the female terminal into a cavity of a female housing including a sealing hole having a larger diameter.

The posture displaying portions of the female housing for displaying the postures of the stabilizers when the female terminal is inserted in an inverted posture may be omitted.

The left and right stabilizers may be displaced in forward and backward directions.

The invention also is applicable to male terminals.

What is claimed is:

1. A terminal fitting (20) for a connector, comprising:

a substantially rectangular tubular main portion (21); and at least one stabilizer (30) extending from a surface (25) of the main portion (21), the stabilizer (30) being formed at a position at a specified distance (D) inward of a lateral edge (25E) of the surface (25) of the main portion (21) toward a widthwise center (WC) and having an oblique posture toward the widthwise center (WC) so that an extending end (30E) of the stabilizer (30) is located within a circumscribed circle (X) of the main portion (21), at least one C-surface (35) being formed on corners of outer lateral edges of an extending end surface (31) of the stabilizer (30) and at least one R-surface (37) being formed on a lateral edge of the C-surface (35) on a base end side of the stabilizer (30).

2. The terminal fitting of claim 1, wherein the at least one stabilizer (30) comprises two stabilizers (30) formed at positions at specified distances (D) in from opposite left and right lateral edges (25E) of the surface (25) of the main portion (21) toward the widthwise center (WC) and having oblique postures so that extending ends (30E) gradually come closer to each other, whereby the extending ends (30E) of the stabilizers (30) are located within a circumscribed circle (X) of the main portion (21).

3. The terminal fitting of claim 2, wherein C-surfaces (35) are formed on corner portions of the outer lateral edges of extending end surfaces (31) of both stabilizers (30) and R-surfaces (37) are formed on lateral edges of the C-surfaces (35) on base end sides of the stabilizers(30).

4. The terminal fitting of claim 3, wherein the C-surfaces (35B) are formed on outer corners of front end surfaces of the stabilizers (30) in an inserting direction of the terminal fitting (20) and the R-surfaces (37B) are formed on rear edges of the C-surfaces (35B).

5. The terminal fitting of claim 2, wherein a lance hole (29) is formed in the surface (25) of the main portion (21) to be engaged with a locking lance (57), and the stabilizers (30) are formed by bending cut pieces at substantially opposite lateral edges of the lance hole (29).

6. The terminal fitting of claim 5, wherein reinforcing beads (39) are formed over the stabilizers (30), the lateral edges of the lance hole (29) and side surfaces (24) of the main portion (21) connect at right angles to the lateral edges of the lance hole (29) to project outward.

7. The terminal fitting of claim 5, wherein the stabilizer (30) has a width shorter than a length of the lance hole (29) in forward and backward directions and wherein a short extending dimension of the stabilizer (30) is less than about half of the width thereof.

8. A fluidproof connector comprising a connector housing (40) and the terminal fitting (20) of claim 1 mounted on an end of a wire (10) together with a resilient plug (15) and being accommodated into a cavity (50) of the connector housing (40) so that the resilient plug (15) is fit in an entrance of the cavity (50) to provide sealing.

9. The fluidproof connector of claim 8, wherein the cavity (50) is formed with a terminal accommodating hole (51) having a substantially rectangular cross section, the main portion (21) of the terminal (20) being closely fit in the terminal accommodating hole (51), and a sealing hole (52) formed at a rear end of the terminal accommodating hole (51) and having a circular cross section, the resilient plug (15) mounted on a rear end of the terminal (20) being fit closely in the sealing hole (52).

10. The fluidproof connector of claim 9, wherein the sealing hole (52) has a diameter substantially equal to a diameter of the circumscribed circle (X) of the main portion (21) of the female terminal (20).

11. The fluidproof connector of claim 10, wherein at least one restricting portion (63) is formed at an edge of the terminal accommodating hole (51) for preventing any further insertion of the terminal fitting (20) by the contact with the stabilizer (30) when the terminal fitting (20) is inserted in an improper posture.

* * * * *